US009153885B2

(12) United States Patent
Schumacher

(10) Patent No.: US 9,153,885 B2
(45) Date of Patent: Oct. 6, 2015

(54) FIELD DEVICE WITH IMPROVED TERMINATIONS

(71) Applicant: Rosemount Inc., Chanhassen, MN (US)

(72) Inventor: Mark S. Schumacher, Minneapolis, MN (US)

(73) Assignee: Rosemount Inc., Chanhassen, MN (US)

( * ) Notice: Subject to any disclaimer, the term of this patent is extended or adjusted under 35 U.S.C. 154(b) by 0 days.

(21) Appl. No.: 13/627,479

(22) Filed: Sep. 26, 2012

(65) Prior Publication Data

US 2014/0087599 A1 Mar. 27, 2014

(51) Int. Cl.

| | |
|---|---|
| ***H01R 4/30*** | (2006.01) |
| ***H01R 11/05*** | (2006.01) |
| ***H01R 4/44*** | (2006.01) |
| *H01R 12/51* | (2011.01) |

(52) U.S. Cl.

CPC ..... *H01R 11/05* (2013.01); *H01R 4/44* (2013.01); *H01R 12/515* (2013.01)

(58) Field of Classification Search

USPC ..... 439/801, 607.01, 92

See application file for complete search history.

(56) References Cited

U.S. PATENT DOCUMENTS

| | | | | |
|---|---|---|---|---|
| 2,967,290 | A | 1/1961 | Zeller | |
| 4,040,700 | A | 8/1977 | Obuch | |
| 4,072,393 | A | 2/1978 | McDermott et al. | |
| 4,174,148 | A * | 11/1979 | Obuch et al. | 439/782 |
| 4,176,904 | A * | 12/1979 | Obuch | 439/690 |
| 4,361,371 | A * | 11/1982 | Williams | 439/76.1 |
| 5,069,636 | A | 12/1991 | Shimirak et al. | 439/412 |
| 5,368,506 | A | 11/1994 | Heimbrock | 439/813 |
| 6,370,448 | B1 | 4/2002 | Eryurek | 700/282 |
| 6,443,783 | B1 | 9/2002 | Beadle | 439/814 |
| 7,559,810 | B1 * | 7/2009 | Wu | 439/801 |
| 7,852,271 | B2 | 12/2010 | Grunig et al. | 343/702 |
| 7,936,174 | B2 * | 5/2011 | Ellis et al. | 324/654 |
| 2004/0077224 | A1 | 4/2004 | Marchese | 439/696 |
| 2011/0134973 | A1 | 6/2011 | Keyes, IV et al. | |

FOREIGN PATENT DOCUMENTS

| | | | |
|---|---|---|---|
| FR | 905 493 | A | 12/1945 |

OTHER PUBLICATIONS

International Search Report and Written Opinion of the International Searching Authority dated Jun. 18, 2013 for International Appln. No. PCT/US2012/067881, filed Dec. 5, 2012.

* cited by examiner

*Primary Examiner* — Jean F Duverne

(74) *Attorney, Agent, or Firm* — Westman, Champlin & Koehler, P.A.

(57) ABSTRACT

A field device is provided. The field device includes field device electronics configured to couple to a transducer. A plurality of terminals is coupled to the field device electronics and is configured to couple the field device to a process communication loop to allow the field device to communicate over the process communication loop. Each of the plurality of terminals is configured to support multiple conductor attachment types.

14 Claims, 4 Drawing Sheets

FIELD DEVICE WITH IMPROVED TERMINATIONS

BACKGROUND

In industrial settings, control systems are used to monitor and control inventories of industrial and chemical processes and the like. Typically, the control system performs these functions using field devices distributed at key locations in the industrial process and coupled to control circuitry in a control room by a process control loop. The term "field device" refers to any device that performs a function in a distributed control or process monitoring system, including all the devices used in the measurement, control and monitoring of industrial processes.

Field devices are used by the process control and measurement industry for a variety of purposes. Usually, such devices have a field-hardened enclosure so that they can be installed outdoors in relatively rugged environments and be able to withstand climatological extremes of temperature, humidity, vibration, mechanical shock, et cetera. These field devices can typically operate on relatively low power. For example, field devices are currently available that receive all of their operating power from a known 4-20 mA loop.

Some field devices include a transducer. A transducer is understood to mean either a device that generates an electrical output based on a physical input or that generates a physical output based on an electrical input. Typically, a transducer transforms an input into an output having a different form. Types of transducers include various analytical equipment, pressure sensors, thermistors, thermocouples, strain gauges, flow sensors, positioners, actuators, solenoids, indicator lights, and others.

Typically, each field device includes communication circuitry that is used for communicating with the process control room, or other circuitry over the process control loop. In some installations, the process control loop is also used to deliver a regulated current and/or voltage to the field device for powering the field device.

Traditionally, analog field devices have been connected to the control room by two-wire process control current loops, with each device being connected to the control room by a single two-wire control loop. Typically, a voltage differential is maintained between the two wires within a range of voltages from 12-45 volts for analog mode and 9-50 volts for digital mode. Some analog field devices transmit a signal to the control room by modulating the current through the current loop to a current that is proportional to a sensed process variable. Other analog field devices can perform an action under the control of the control room by controlling the magnitude of the current through the loop. Some process control loops also carry digital signals for communication with field devices. Digital communication allows a much larger degree of communication than analog communication. Moreover, digital field devices do not require separate wiring runs for each field device. Further, field devices that communicate digitally can respond to and communicate selectively with the control room and/or field devices.

SUMMARY

A field device is provided. The field device includes field device electronics configured to couple to a transducer. A plurality of terminals is coupled to the field device electronics and is configured to couple the field device to a process communication loop to allow the field device to communicate over the process communication loop. Each of the plurality of terminals is configured to support multiple conductor attachment types.

DETAILED DESCRIPTION OF ILLUSTRATIVE EMBODIMENTS

Figure 1:
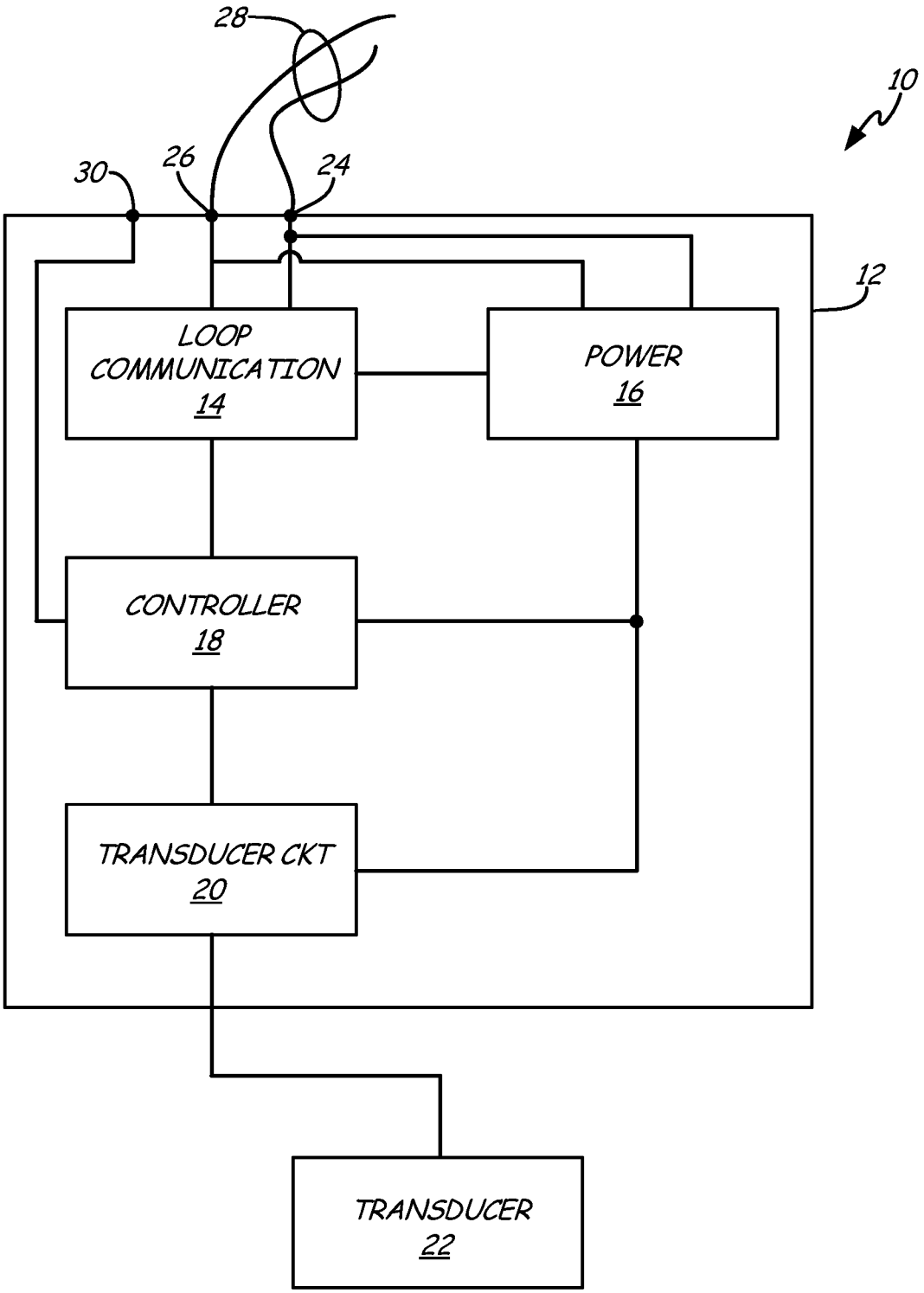
FIG. 1 is a diagrammatic view of a field device with which embodiments of the present invention are particularly useful.

FIG. 1 is a diagrammatic view of a field device with which embodiments of the present invention are particularly useful. Field device 10 includes a field-hardened enclosure 12 within which are disposed loop communication module 14, power module 16, controller 18 and transducer circuitry 20. In embodiments where field device 10 is a process variable transmitter, transducer circuitry 20 may include measurement circuitry, such as an analog-to-digital converter. Transducer circuitry 20 is operably coupleable to transducer 22. Transducer 22 may be disposed remotely from field device 10, or may be disposed within enclosure 12 of field device 10. In some embodiments, transducer 22 is a sensor that provides a sensor output related to a process variable such as process fluid temperature or pressure.

Loop communication module 14 is coupled to a plurality of conductor terminations or terminals 24, 26, that enable field device 10 to be coupled to a process communication loop 28. Process communication loop 28 is any arrangement of conductors that provides communication in at least one direction between field device 10 and another device. Field device 10 may include additional terminals, such as terminal 30 to allow for additional features for enhanced local interaction, such as testing or diagnostics. In some embodiments, loop communication module 14 is configured to interact with signals on the process communication loop 28 and provide information indicative of such signals to controller 18. Additionally, in some embodiments, field device 10 is able to be powered completely by energy received through process control loop 28. Power module 16 is configured to receive such power and condition the power for provision to other components with field device 10, such as loop communication module 14, controller 18, and transducer circuitry 20.

Controller 18 is preferably a microprocessor that is configured to execute programmatic instructions to provide field device functionality. In embodiments where field device 10 is a process variable transmitter, controller 18 is configured, through hardware, software or both, to periodically interact with transducer circuitry 20 to obtain periodic process variable measurements and provide information relative to such measurements to loop communication module 14 for communication over the process control loop 28.

Currently, coupling conductors to field device 10 is done in accordance with appropriate standards for the location where the field device will be installed. For example, if the field device is to be installed in a jurisdiction such as the United States, a first type of conductor attachment type is employed. For example, a spade lug is attached to a stripped end of the wire. The spade lug is then attached to a screw terminal on the field device. However, if the field device is to be installed in another jurisdiction, such as Europe, a second type of conductor attachment type is employed. For example, in Europe, a stripped end of a wire is simply inserted into a terminal and clamped therein by a set screw. Given the different requirements of conductor attachment types for various jurisdictions, a plurality of different types of field device connections must be offered. As a result, manufacturers offer field devices with different types of conductor attachment types for essentially the same purpose. This increases complexity and cost while decreasing the service level provided to the end user. Additionally, if an end user orders a field device and does not specify the conductor attachment type, or specifies the wrong conductor attachment type, the user will receive a field device that is not able to be physically connected to their wired process control loop while complying the applicable jurisdiction's approval standard(s).

Embodiments of the present invention provide a field device having a plurality of loop terminations, where each loop termination has a plurality of conductor attachment types. Accordingly, a manufacturer can simply provide a field device having loop terminations in accordance with embodiments of the present invention and it is impossible for an end user to receive the wrong conductor attachment type for their jurisdiction. This not only enhances user satisfaction, but can potentially reduce manufacturing costs, since the design is standardized on a single design that provides both conductor attachment types.

Figure 2:
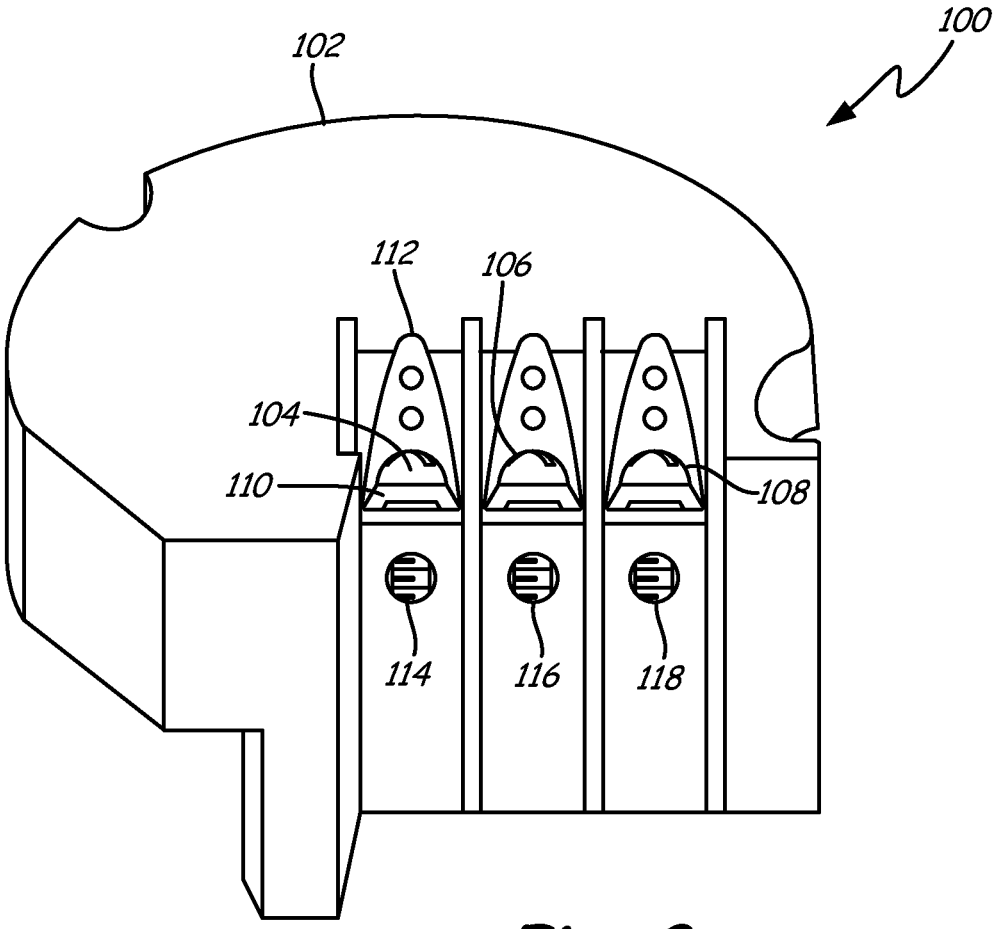
FIG. 2 is a diagrammatic view of a field device, such as a process variable temperature transmitter, having improved process communication loop terminations in accordance with an embodiment of the present invention.

FIG. 2 is a diagrammatic view of a field device 100, such as a process variable temperature transmitter, having improved process communication loop terminations in accordance with an embodiment of the present invention. Process variable temperature transmitter 100 includes a transmitter body 102 within which is disposed process variable transmitter electronics, such as those described above with respect to FIG. 1. The transmitter electronics may be potted within housing 102, which may then be disposed within a robust enclosure such as a head-mount enclosure. As illustrated in FIG. 2, three distinct terminals are provided on process variable transmitter 100. Each such terminal includes two potential termination types. Specifically, threaded fasteners 104, 106, 108 are provided to bear against clamping plates 110 and lead termination bracket 112. Each such threaded fastener 104, 106, 108 also passes into a respective transverse bore 114, 116, 118. This arrangement provides highly useful lead termination in accordance with embodiments of the present invention. Specifically, wire terminations that require spade lugs may be attached between clamping plates 110 and lead attachment brackets 102. Alternatively, if the jurisdiction requires European-style terminations, the stripped wire can simply be inserted into the transverse bore 114, 116, 118, and then the respective threaded fastener 104, 106, 108 can be rotated to bear against and retain the stripped wire. In this manner, each such threaded fastener is useful for both spade lug and stripped-wire terminations. Moreover, embodiments of the present invention provide highly compact lead attachment, which is important in field devices that have little extra room when they are mounted within field-hardened enclosures.

Figure 3:
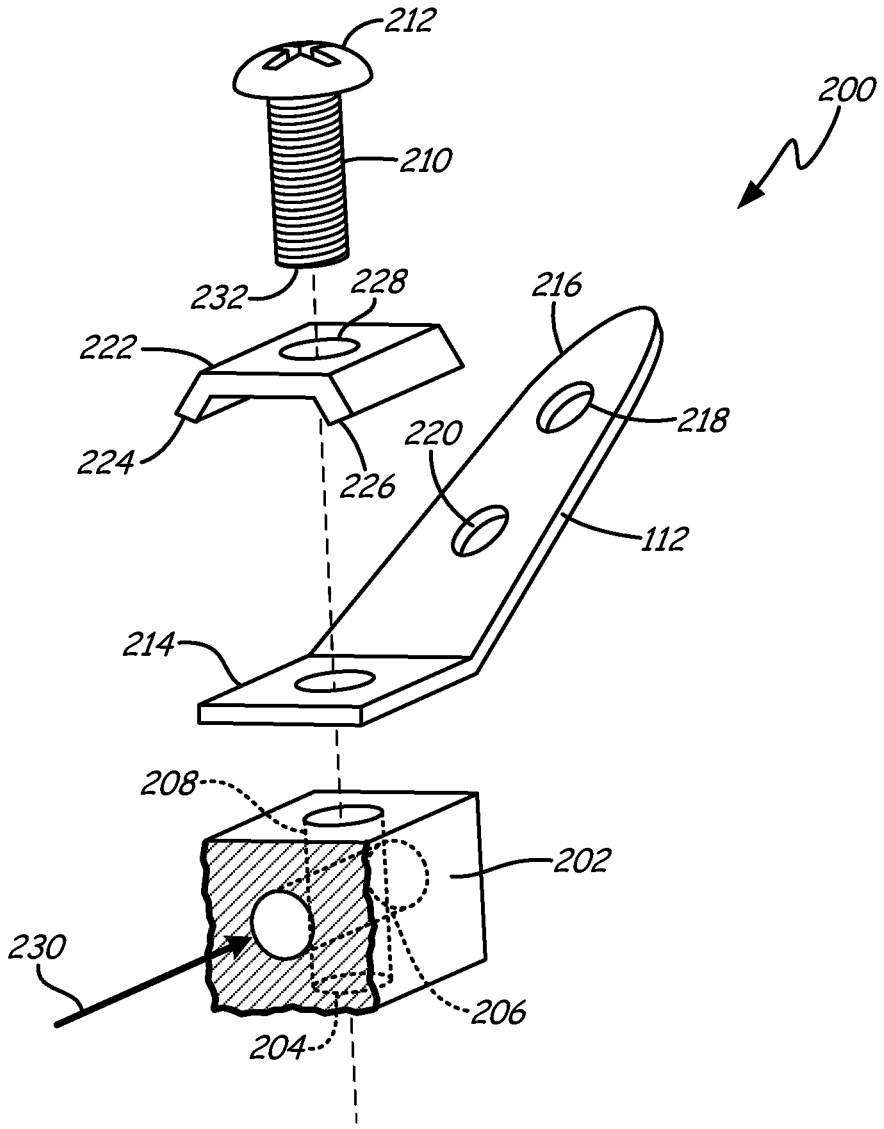
FIG. 3 is a diagrammatic exploded view of a loop termination in accordance with an embodiment of the present invention.

FIG. 3 is a diagrammatic exploded view of a wire termination in accordance with an embodiment of the present invention. Termination 200 includes conductive block 202 that is welded, soldered or otherwise affixed to a circuit board adjacent surface 204. Block 202 includes transverse bore 206 and threaded passageway 208. Threaded passageway 208 intersects transverse bore 206 and is internally threaded in order to receive external threads 210 of threaded fastener 212. FIG. 3 also illustrates lead attachment bracket 112 having a base portion 214 and an upwardly extending, angled lead attachment portion 216. Upwardly extending, angled lead attachment portion 216 includes a pair of apertures 218, 220 that are configured to receive clips such as from a test instrument or handheld communicator. Termination 200 also includes clamping plate 222 having a pair of angled arms 224, 226 extending downwardly therefrom. Clamping plate 222 includes aperture 228 that is sized to pass the external threads of threaded fastener 212. In applications where the field device is to be used with a spade lug, the lug is clamped between base portion 214 and angled downwardly extending arms 224, 226. Additionally, in embodiments where the lead is a stripped wire, the stripped wire is inserted as indicated at arrow 230 into transverse bore 206. Then, threaded fastener 212 is rotated such that bottom surface 232 is driven into contact with the stripped wire. In this manner, both spade lug connections and stripped-wire connections can be accommodated in an extremely compact form factor.

Figure 4:
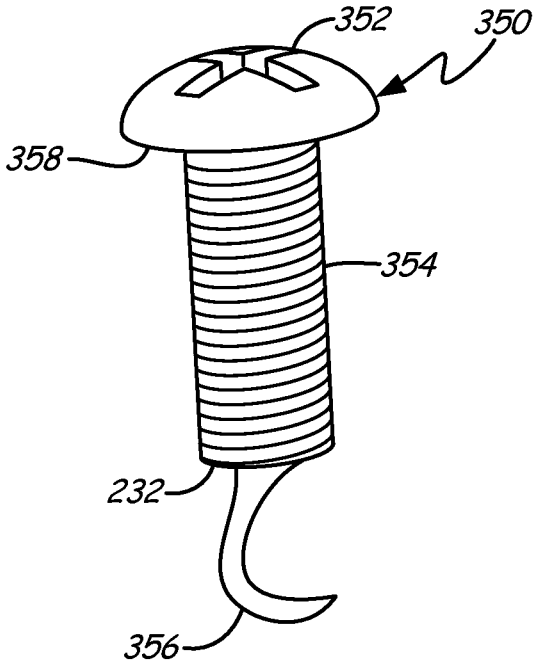
FIG. 4 is a diagrammatic view of a threaded fastener modified to provide enhanced wire clamping in accordance with an embodiment of the present invention.

FIG. 4 is a diagrammatic view of a threaded fastener modified to provide enhanced wire clamping in accordance with an embodiment of the present invention. Fastener 350 has a fastener head 352 configured to engage a suitable tool, such as a screwdriver. Fastener 350 also includes an externally threaded portion 354 that is threadably received within internally threaded bore 208. However, fastener 350 also has a deformable lead engagement member 356 attached at bottom surface 232. Lead engagement member 356 is configured to engage the lead and provide a relatively fixed amount of pressure against the lead while fastener 350 is being driven home. Lead engagement member 356 is preferably formed of a metal and is conductive. Preferably, lead engagement member 356 is formed from the same material from which the rest of fastener 350 is formed. Additionally, if surface 358 of fastener 350 bears against its final position before lead engagement member 356 is completely collapsed, the amount of pressure applied to the stripped wire can be maintained within a relatively fixed range. This is contrast to embodiments where the bottom surface 232 merely bears directly against the stripped wire. In such circumstances, the force applied against the stripped wire is much higher because it is directly related to the torque applied to the threaded fastener. In embodiments where lead engagement member 356 is used and surface 358 finds home before lead engagement member 356 is completely collapsed, the amount of pressure exerted by member 356 upon the stripped wire is related to the amount of deformation of member 356, the Young's modulus of the material from which member 356 is constructed, and its geometry.

Although the present invention has been described with reference to preferred embodiments, workers skilled in the art will recognize that changes may be made in form and detail without departing from the spirit and scope of the invention.

What is claimed is:

1. A field device comprising:

field device electronics coupled to a transducer;

a plurality of loop terminations coupled to the field device electronics and which electrically connect the field device to a process communication loop to allow the field device to communicate over the process communication loop; and wherein each of the plurality of loop terminations comprises a plurality of different conductor attachment types to couple to a plurality of different types of loop conductors, the plurality of different types of loop conductors comprising at least one of a spade lug and a stripped end of a wire.

2. The field device of claim 1, wherein each of the plurality of loop terminations includes a threaded fastener that is threadably received in a block having a transverse bore sized to receive the stripped end of the wire.

3. The field device of claim 1, wherein the block is conductive.

4. The field device of claim 2, wherein the block is attached to a printed circuit board.

5. The field device of claim 2, and further comprising a lead attachment bracket disposed between a head of the threaded fastener and the block.

6. The field device of claim 5, and further comprising a clamping plate disposed between the head and the lead attachment bracket.

7. The field device of claim 5, wherein the lead attachment bracket extends upwardly at an angle and has at least one aperture for receiving a test clip.

8. The field device of claim 2, wherein the threaded fastener has a bottom surface configured to engage the stripped end of the wire.

9. The field device of claim 8, wherein the threaded fastener includes a lead engagement member.

10. The field device of claim 9, wherein the lead engagement member deflects to deflect as the threaded fastener is tightened on the stripped end of the wire.

11. The field device of claim 10, wherein the lead engagement member is semicircular.

12. The field device of claim 1, wherein the field device is completely powered through the plurality of loop terminations.

13. The field device of claim 1, wherein the transducer is a process variable sensor and wherein the field device electronics include a loop communication module operably coupled to the plurality of loop terminations to convey a signal representative of a process variable measurement from the process variable sensor over the process communication loop.

14. The field device of claim 1, and further comprising a field-hardened enclosure containing the field device electronics.

* * * * *